US005265295A

United States Patent [19]

Sturgis

[11] Patent Number: 5,265,295

[45] Date of Patent: Nov. 30, 1993

[54] CUSHION CONSTRUCTION AND METHOD

[76] Inventor: William G. Sturgis, 117 W. Johnson Ave., Somers Point, N.J. 08244

[21] Appl. No.: 968,669

[22] Filed: Nov. 2, 1992

[51] Int. Cl.[5] ..... A47C 27/14

[52] U.S. Cl. ..... 5/481; 5/460; 5/448

[58] Field of Search ..... 5/402, 448, 460, 470, 5/471, 481, 490, 636; 297/452

[56] References Cited

U.S. PATENT DOCUMENTS

| | | | |
|---|---|---|---|
| 69,379 | 10/1867 | Walton . | |
| 1,130,946 | 3/1915 | Van Gelder . | |
| 1,560,772 | 11/1925 | Fowler . | |
| 2,093,713 | 9/1937 | Dayhuff et al. | 5/460 |
| 2,399,617 | 1/1944 | Clark | 5/448 |
| 2,610,337 | 9/1952 | McMillin et al. | 5/361 |
| 2,643,399 | 6/1953 | Haefliger | 5/460 |
| 3,243,828 | 4/1966 | McCarty | 5/636 |
| 3,283,345 | 11/1966 | Berck | 5/345 |
| 3,512,191 | 5/1970 | Wall et al. | 5/460 |
| 3,774,250 | 11/1973 | Miller | 5/471 |
| 3,853,352 | 12/1974 | Ambrose | 297/452 |
| 4,080,675 | 3/1978 | Kanowsky et al. | 5/345 |
| 4,521,928 | 6/1985 | Stephenson | 5/460 X |
| 4,784,437 | 11/1988 | Shimada | 5/460 X |
| 4,833,741 | 5/1989 | Mizuno et al. | 5/481 X |
| 4,867,508 | 9/1989 | Urai | 5/481 X |
| 4,928,337 | 5/1990 | Chauncey | 5/465 |
| 4,975,996 | 12/1990 | Evans et al. | 5/464 |
| 5,160,785 | 11/1992 | Davidson, Jr. | 5/481 X |

FOREIGN PATENT DOCUMENTS

| | | | |
|---|---|---|---|
| 192535 | 2/1923 | United Kingdom | 5/460 |

*Primary Examiner*—Peter M. Cuomo
*Assistant Examiner*—Michael Milano

[57] ABSTRACT

A cushion construction is provided whereby a resilient polymeric foam core is covered with an intermediate flexible non-woven fabric which is adhered to the foam by mechanical force with the ends of the intermediate fabric urged into slits formed in the polymeric core. A conventional decorative outer fabric is sewed or otherwise attached over the intermediate fabric to complete the cushion construction. The completed cushion is lightweight and requires no adhesives or solvents in its method of manufacture.

8 Claims, 2 Drawing Sheets

CUSHION CONSTRUCTION AND METHOD

BACKGROUND OF THE INVENTION

1. Field of the Invention

The invention herein pertains to furniture cushions and a method of making the same and particularly to a laminated cushion construction having a resilient core with an intermediate flexible non-woven fabric layer surrounding the core and covered with an outer woven fabric.

2. Description of the Prior Art and Objectives of the Invention

Manufacturing processes of cushions and related items have for many years employed synthetic polymeric foams such as polyurethane having a density of from one to five pounds per cubic foot to provide the necessary comfort, resiliency and durability required for sofas, chairs and other articles. More recently, cushion laminates have been utilized in which a resilient foam core is wrapped or covered with a protective intermediate layer to which a decorative outer fabric cover is applied. It is conventional to attach the intermediate layer which may consist of a relatively thin non-woven material or otherwise to the foam core by sewing or by the use of various solvent containing adhesives. Sewing of the laminate to the foam core is time consuming, expensive and is difficult to learn due to the different material used and the difference in sizes of the laminates and foam cores. During application of adhesives and during the drying stages, the adhesive solvents are released into the atmosphere, providing potential environmental damage and more recently, violations of certain safety and health laws and regulations. The adhesives employed have maintained the intermediate layer to the resilient core adequately and have prevented movement or slippage between the intermediate layer and polyurethane foam or other polymeric core. Recently, cushion manufacturers have had to take added precautions and sometimes have had to purchase solvent collecting equipment when using adhesives due to new environmental and safety regulations which generally increase production costs and diminish profits.

With the aforesaid disadvantages of conventional cushion construction methods, it is one objective of the present invention to provide a new method of cushion construction which eliminates the need of sewing the laminate to the foam core and of solvent containing adhesives and special solvent evaporation equipment to handle the same.

It is yet another objective of the present invention to provide a cushion construction and method which will tightly adhere a flexible layer to a resilient polymeric foam core without increasing the manufacturer's costs.

It is yet another objective of the present invention to provide a cushion construction and method which employs a mechanical bond to maintain the integrity between an intermediate flexible layer and a resilient inner core as the ends of the flexible layer are frictionally held in slits placed in the resilient core.

Various other objectives and attributes of the present invention will become apparent to those skilled in the art as more details of the invention unfold below.

SUMMARY OF THE INVENTION

The aforesaid and other objectives are realized by providing a cushion construction whereby a conventional resilient polymeric foam core is cut to size and slit with a thin blade along its ends. A flexible fabric intermediate layer is then placed over the resilient core and the ends of the fabric are inserted into the slits. The resiliency of the core causes the fabric filled slits to squeeze or pinch the ends of the flexible layer therein, thereby frictionally engaging the fabric and securely maintaining the flexible layer on the resilient core. After the flexible fabric layer has been so attached, the core and attached layer are covered with a suitable decorative woven outer fabric or the like to complete the cushion construction.

DESCRIPTION OF THE PREFERRED EMBODIMENT

Figure 2:
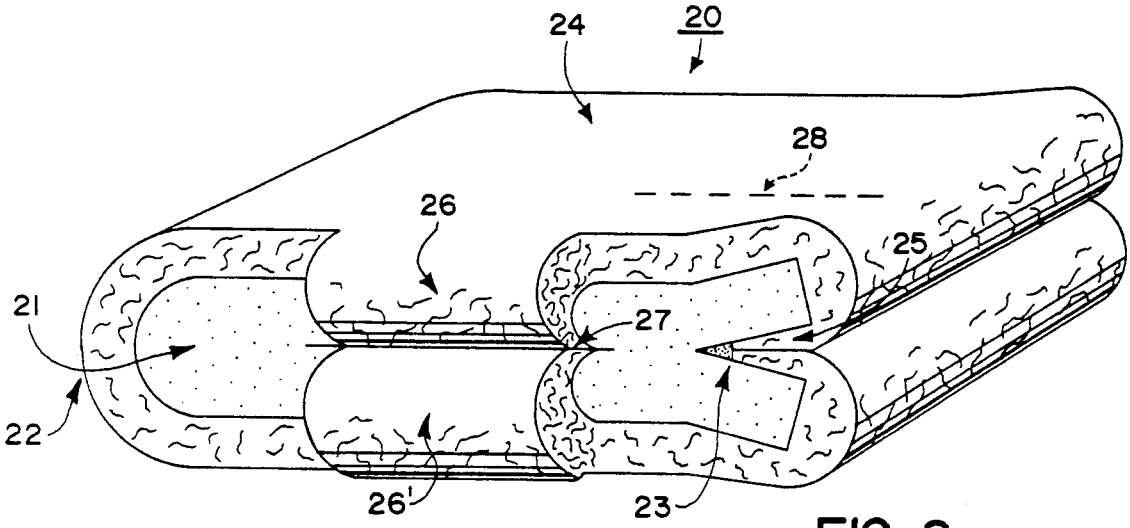
FIG. 2 illustrates a polymeric foam core which has a rounded left side and a slit along the right side for receiving the ends of the intermediate flexible layer positioned thereover.

The preferred form of the cushion construction is shown in FIG. 2 and the preferred method for forming the same includes cutting a polyurethane foam block having a density of four pounds per cubic foot with a rounded end and placing slits with a thin blade along the front, back and right sides thereof as substantially shown in FIG. 2. Next, the construction method includes the placement of a flexible intermediate non-woven fabric having side flaps over the foam core and both ends of the flexible layer are inserted into the right side slit as shown. The resiliency of the foam core causes the slit to attempt closure and tightly engage the flexible layer ends. Next, the side flaps of the flexible layer are tucked within the foam core side slits where they are likewise frictionally engaged to thereby complete the central cushion construction, afterwhich a decorative woven outer fabric or the like can be placed thereover to provide a durable, unique chair or sofa cushion without subjecting the employees to the hazards of volatile chemical solvents as are contained within many liquid adhesives utilized in the trade.

DETAILED DESCRIPTION OF THE DRAWINGS AND EXPLANATION OF THE INVENTION

Figure 1:
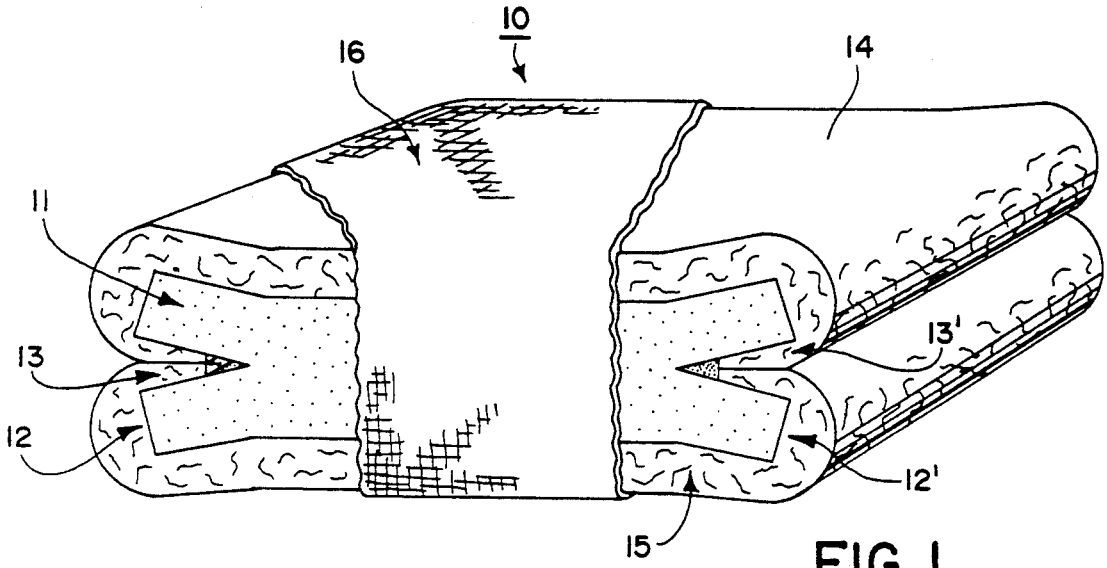
FIG. 1 shows a rectangularly-shaped cushion construction in which the core has been slit along two opposing sides.

For a better understanding of the invention, turning now to the drawings, FIG. 1 demonstrates cushion construction 10 having a conventional core consisting of a polyurethane foam block 11. As shown, resilient polyurethane block 11 may be for example, eighteen inches long, eighteen inches wide with a thickness of two to eight inches and a density of one to five pounds per cubic foot. Along sides 12, 12' thin slits 13, 13' have been placed with a blade within foam block 11 and may extend inwardly for approximately three to four inches. Slits 13, 13' are openable as shown in FIG. 1 to allow the insertion of the ends of non-woven intermediate flexible layers 14 and 15 which cover the top and bottom respectively of foam block 11. Flexible layers 14 and 15 may comprise a non-woven fabric formed from Dacron or other synthetic fibers and may have a thickness of three-quarter to two and one-half inches. Layers 14 and 15 and are compressible for easy insertion into slits 13, 13' where layers 14 and 15 are tightly, frictionally engaged. As would be understood by those skilled in the art, cushion construction 10 requires no adhesives and therefore does not pollute the environment with gaseous, harmful solvents which now may require special expensive equipment for handling and disposal. A conventional woven fabric 16 forms the outer layer or covering of cushion construction 10 and can be sewed or otherwise attached. Vinyl or leather may also be used as an outer covering in place of fabric 16. As shown, cushion construction 10 is lightweight, durable, easy and safe to assemble and will withstand long periods of use without losing its form or resiliency.

Another embodiment of a cushion is shown in FIG. 2 whereby cushion construction 20 shown therein comprises a substantially rectangular foam core 21 cut from a large polyurethane block or mass, but unlike foam block 11, foam core 21 has a rounded side 22 and is slit only along side 23. Flexible layer 24 is wrapped around side 22 and both ends of intermediate flexible non-woven layer 24 are tightly inserted into slit 25. As further shown in FIG. 2, outer cover 24 has a pair of front flaps 26, 26' which are inserted into front side slit 27. As understood, a rear side slit 28 shown in phantom lines is also available for receiving similar rear flaps 29, 29' (not shown).

Figure 3:
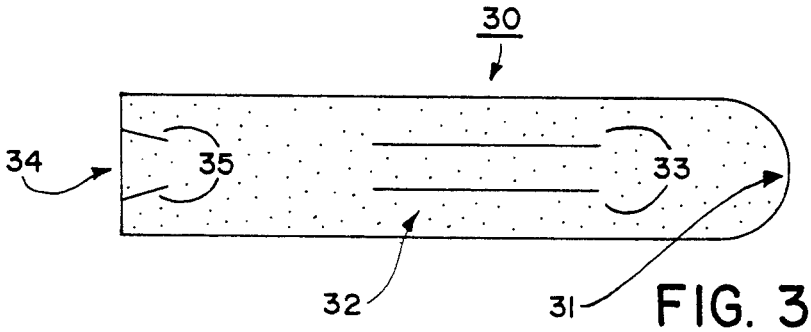
FIG. 3 demonstrates yet another flexible core having double front and left side slits.

In FIG. 3, foam block 30 is shown having a rounded right side 31, a front side 32 with slits 33 and a left side 34 with slits 35. Foam block 30 having pairs of slits as shown provides convenience in assembly, depending on the particular flexible layer employed. For example, when a thicker, intermediate flexible non-woven layer is used, left side slits 35 each may accommodate one end of the flexible layer and provide less bulk than as shown in FIG. 2 whereby a pair of flexible layer ends are inserted into single slit 25.

Figure 4:
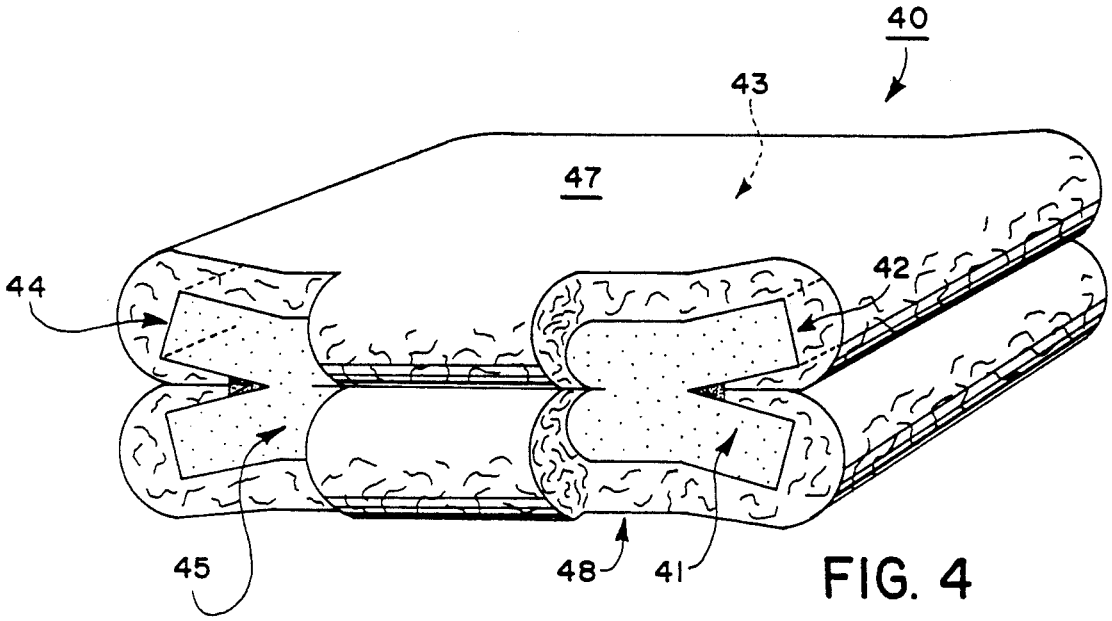
FIG. 4 demonstrates a substantially rectangularly-shaped core having slits along all four sides.

In FIG. 4, cushion construction 40 comprises a substantially rectangular shaped polyurethane foam core 41. Foam block 41 defines single, individual slits along each of its four sides 42, 43, 44 and 45. Separate flexible top layer 47 and bottom layer 48 are attached thereto by insertion of the flap ends into the provided slits on sides 42, 43, 44 and 45.

Figure 5:
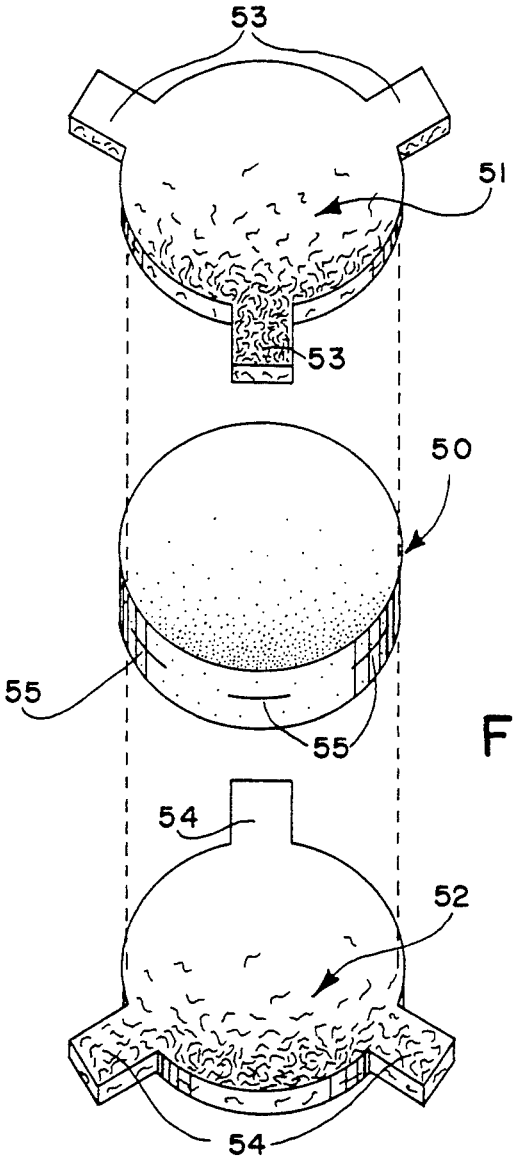
FIG. 5 shows a cylindrically-shaped core with top and bottom flexible layers for attachment thereto.

FIG. 5 illustrates round polyurethane foam block or core 50 with top flexible member 51 and bottom flexible member 52 removed therefrom. Flaps 53 and 54 are insertable within side slits 55 to maintain intermediate non-woven flexible members 51, 52 suitably attached to block 50.

The construction herein allows for easy disassembly and separation of the foam or core and flexible member when use of the cushion is finished so the core and flexible member can be easily recycled.

As would be understood, the cushion construction as shown herein utilizes a foam block or core cut or formed from a large polyurethane block or mass having a density of approximately one to five pounds per cubic foot and a thickness of approximately three inches. However, depending on the particular structural characteristics desired, the core can be formed from other materials, densities, resiliencies, polymeric materials or thicknesses. Likewise, the intermediate flexible layer which engages and surrounds the resilient core can likewise be made of a variety of materials as can the outer covering and the examples and illustrations herein are merely for explanatory purposes and are not intended to limit the scope of the appended claims.

I claim:

1. A frameless furniture cushion comprising: a resilient core, said core comprising a block, said block having substantially vertical end walls, said core defining a slit, along each vertical end wall of said block, said slit extending the full length of said vertical end wall, separate top and bottom relatively thin flexible layers, said top flexible layer for positioning over the top of said core, said bottom layer for positioning over the bottom of said core, each of said slits for receiving one end of said top and one end of said bottom flexible layer to maintain said flexible layers securely on said core without the use of bonding agents.

2. The cushion of claim 1 and including an outer cover, said cover positioned on said flexible layers.

3. The cushion of claim 1 wherein said resilient core comprises a polymeric foam.

4. The cushion of claim 3 wherein said polymeric foam is polyurethane.

5. The cushion of claim 4 wherein said polyurethane foam has a density of one to five pounds per cubic foot.

6. The cushion of claim 4 wherein said polyurethane foam has a thickness of approximately three inches.

7. The cushion of claim 1 wherein said flexible layer have a thickness of from three quarter to two and one-half inches.

8. The cushion of claim 1 wherein said flexible layers each comprises a non-woven synthetic fabric.

* * * * *